US005827104A

United States Patent [19]

Zheng

[11] Patent Number: 5,827,104

[45] Date of Patent: Oct. 27, 1998

[54] CONSTRUCTIONAL TOY PIECES

[75] Inventor: Yu Zheng, Covina, Calif.

[73] Assignee: Patent Category Corporation, Monrovia, Calif.

[21] Appl. No.: 669,253

[22] Filed: Jun. 24, 1996

Related U.S. Application Data

[63] Continuation-in-part of Ser. No. 584,519, Jan. 11, 1996, Pat. No. 5,605,486.

[51] Int. Cl.[6] ..... A63H 33/08

[52] U.S. Cl. ..... 446/114; 273/160

[58] Field of Search ..... 446/97, 99, 114; 273/156, 157 R, 160

[56] References Cited

U.S. PATENT DOCUMENTS

| | | | |
|---|---|---|---|
| D. 4,058 | 5/1870 | Ellis . | |
| D. 245,435 | 8/1977 | Gnehm . | |
| D. 247,132 | 1/1978 | Gnehm . | |
| 1,163,851 | 12/1915 | Pringle . | |
| 1,455,009 | 5/1923 | Schenk | 273/160 |
| 1,562,006 | 2/1925 | Sichterman . | |
| 1,898,297 | 9/1933 | Fox . | |
| 2,278,327 | 8/1942 | Magnus et al. | 446/124 |
| 2,569,107 | 1/1951 | Johnson . | |
| 2,633,662 | 10/1953 | Nelson . | |
| 2,731,766 | 1/1956 | Rubin | 446/99 |
| 2,800,743 | 3/1957 | Meehan et al. . | |
| 2,836,421 | 5/1958 | Turner | 273/160 |
| 3,023,890 | 3/1962 | Scholten . | |
| 3,701,214 | 10/1972 | Sakamoto | 446/115 |
| 3,790,175 | 2/1974 | Ragnow | 273/160 |
| 3,891,335 | 6/1975 | Feil . | |
| 3,903,616 | 9/1975 | Gage | 273/160 X |
| 4,874,341 | 10/1989 | Ziegler | 446/109 |
| 5,163,862 | 11/1992 | Phillips et al. | 446/114 |
| 5,215,490 | 6/1993 | Szoradi | 446/115 |
| 5,251,900 | 10/1993 | Gallant | 273/157 R |
| 5,281,181 | 1/1994 | McCollum | 446/106 |
| 5,378,185 | 1/1995 | Ban | 446/124 |
| 5,605,486 | 2/1997 | Zheng | 446/114 |

FOREIGN PATENT DOCUMENTS

| | | | |
|---|---|---|---|
| 132550 | 5/1949 | Australia | 446/114 |
| 891849 | 12/1943 | France | 446/99 |
| 648025 | 12/1950 | United Kingdom . | |
| 1394020 | 5/1975 | United Kingdom . | |
| 2054393 | 2/1981 | United Kingdom . | |

*Primary Examiner*—William H. Grieb
*Attorney, Agent, or Firm*—Raymond Sun

[57] ABSTRACT

An object is assembled by interconnecting a plurality of puzzle pieces. The object includes first and second puzzle pieces, each having a joint positioned along a first outer side edge and having a substantially U-shaped mortise comprising a bottom edge, and first and second inner side edges extending from the bottom edge. The bodies of the first and second puzzle pieces are transverse to each other when the joint of the first puzzle piece is interconnected with the joint of the second puzzle piece.

18 Claims, 4 Drawing Sheets

CONSTRUCTIONAL TOY PIECES

RELATED APPLICATION

This application is a continuation-in-part of application Ser. No. 08/584,519, filed Jan. 11, 1996, now U.S. Pat. No. 5,605,486, entitled "Three Dimensional Model Structures", which is incorporated by this reference as though set forth fully herein.

BACKGROUND OF THE INVENTION

1. Field of the Invention

The present invention relates to three-dimensional objects, and in particular, to puzzle or constructional toy pieces that can be used to assemble three-dimensional objects.

2. Description of the Prior Art

For purposes of the present application, the terms "puzzle piece" and "constructional toy piece" shall be used interchangeably, and are intended to have the same meaning.

Puzzles and constructional toys are popular among both children and adults. A two-dimensional puzzle usually involves the selection and sequential assembly of a plurality of puzzle pieces having varying contour to create an original image about a flat sheet board. More complex puzzles include three-dimensional self-standing structures that are assembled by interlocking a variety of puzzle pieces.

Examples of prior three-dimensional structures that are assembled from puzzle pieces are illustrated in U.S. Pat. Nos. 2,278,327 (Magnus et al.), 3,701,214 (Sakamoto) and 5,251,900 (Gallant), in which the puzzle pieces are interconnected by means of dovetail joints. However, these prior puzzle pieces suffer from the drawback that the puzzle pieces do not allow the user to assemble a wide variety of three-dimensional model objects.

For example, U.S. Pat. No. 2,278,327 (Magnus et al.) discloses constructional blocks having substantially U-shaped mortise joints or units. Most of the blocks illustrated in U.S. Pat. No. 2,278,327 (Magnus et al.) have a configuration that is based on portions or multiples of the basic U-shaped units. The inner side edges of the U-shaped openings of these U-shaped units extend vertically (i.e., at ninety degrees) with respect to the units, and none of these inner side edges extend at other angles, so the number and types of connections that can be achieved between similar joints are limited.

Thus, there remains a need for a plurality of puzzle pieces that can be assembled into a wide variety of two- and three-dimensional objects.

SUMMARY OF THE DISCLOSURE

In order to accomplish the objects of the present invention, there is provided an object assembled by interconnecting a plurality of puzzle pieces. The object comprises first and second puzzle pieces, each having a joint positioned along a first outer side edge and having a substantially U-shaped mortise comprising a bottom edge, and first and second inner side edges extending from the bottom edge. The bodies of the first and second puzzle pieces are transverse to each other when the joint of the first puzzle piece is interconnected with the joint of the second puzzle piece. When interconnected, the inner side edges of the joint of the first puzzle piece grip the body of the second puzzle piece, and the inner side edges of the joint of the second puzzle piece grip the body of the first puzzle piece.

In accordance with one aspect of the present invention, the length of the inner side edges of the joints of the puzzle pieces can be different to vary the depth of the U-shaped openings, and the bottom edges of the joints of the puzzle pieces can be provided with different widths to vary the size of the U-shaped openings.

In accordance with another aspect of the present invention, joints can be provided at the corners between two adjacent outer side edges, with the first inner side edge of these corner joints extending from the bottom edge of the joint to the first outer side edge, and the second inner side edge of these corner joints extending from the bottom edge of the joint to the second outer side edge. The angles defined by the first and second inner side edges and the first and second outer side edges, respectively, can be the same, or they can be different to vary the width of the opening throughout the U-shaped mortise.

In accordance with yet another aspect of the present invention, one or more joints provided along an outer side edge may be angled with respect to the outer side edge, so that the first inner side edge of the joint is positioned at a first angle of greater than zero degrees and less than ninety degrees with respect to the first outer side edge, and the second inner side edge of the joint is positioned at a second angle of greater than ninety degrees and less than 180 degrees with respect to the first outer side edge. The first angle and the second angle can add up to a total angle which is equal to 180 degrees, less than 180 degrees, or greater than 180 degrees to vary the width of the opening throughout the U-shaped mortise.

In accordance with a further aspect of the present invention, the bodies of the first and second puzzle pieces may be provided with designs, so that the designs of the first and second puzzle pieces match each other when the joints of the first and second puzzle pieces are interconnected.

Thus, the puzzle pieces according to the present invention can be used to assemble a large variety of two and three-dimensional objects. These connections are easy to achieve, and are secure.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figures 6, 7:
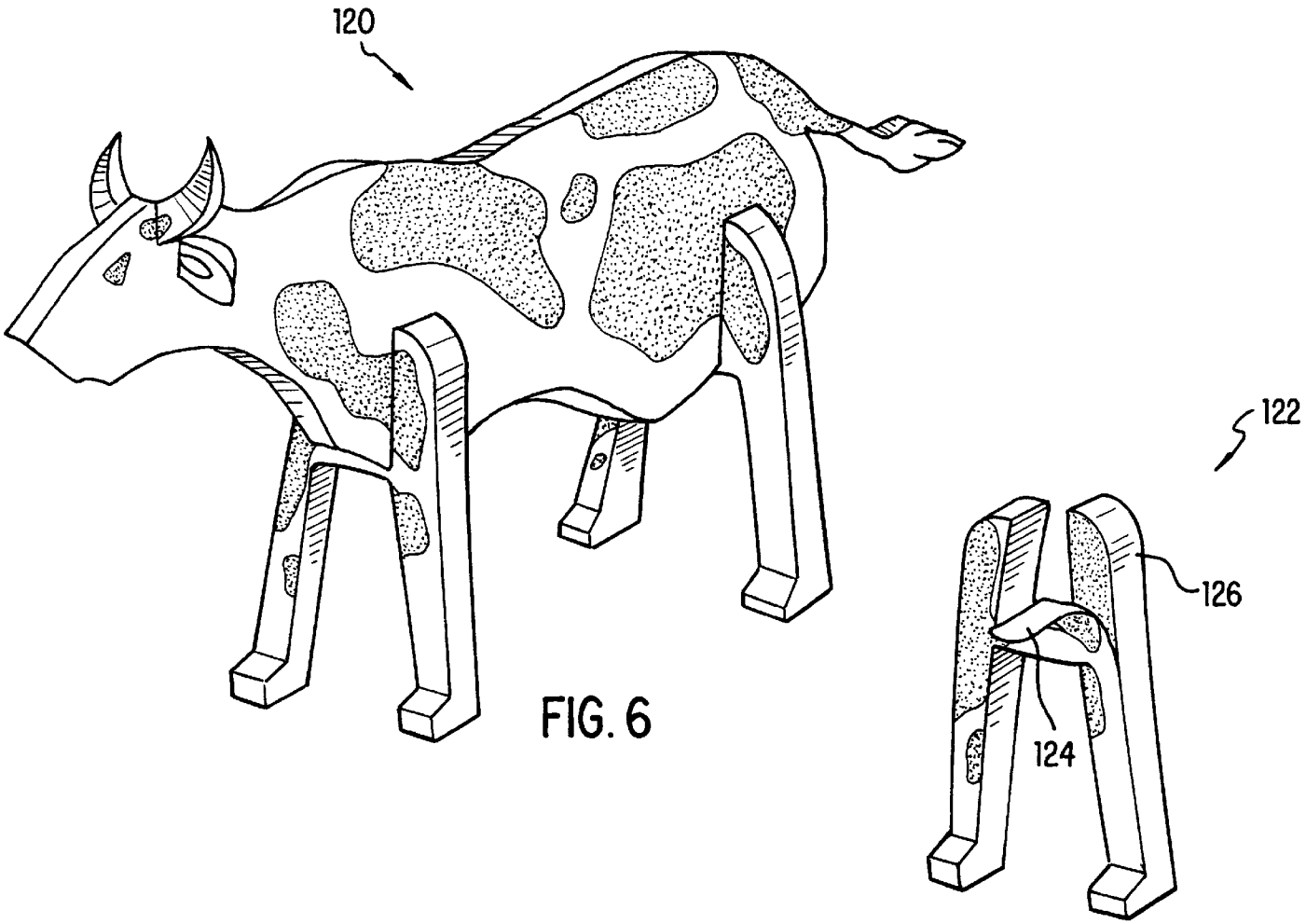
FIG. 6 is a perspective view of a three-dimensional model object, a cow, assembled with the interconnecting puzzle pieces according to the present invention.
FIG. 7 illustrates a rear leg piece of the cow of FIG. 6 with a lamination or design applied thereto.

A three-dimensional self-standing model structure 120 is shown in FIG. 6. Model structure 120, a cow, is assembled by connecting a plurality of puzzle pieces or constructional toy pieces which will be described in connection with FIGS. 1–5. The puzzle pieces may have images provided on their surfaces to decorate the object, as described in greater detail hereinbelow. The puzzle pieces according to the present invention can be assembled to create a variety of two and three dimensional objects, including but not limited to planes, ships, trains, buildings, furniture, automobiles, animals, plants, and abstract sculptures, as well as useful utility household items, gardening items, wearable accessories (such as belts and jewelry), and other items.

Figure 2:
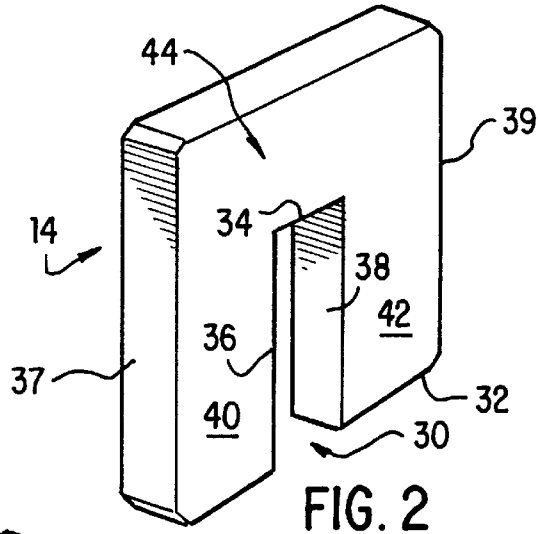
FIGS. 1 and 2 illustrate perspective views of portions of two interconnecting puzzle pieces according to a first embodiment of the present invention.
Figure 1:
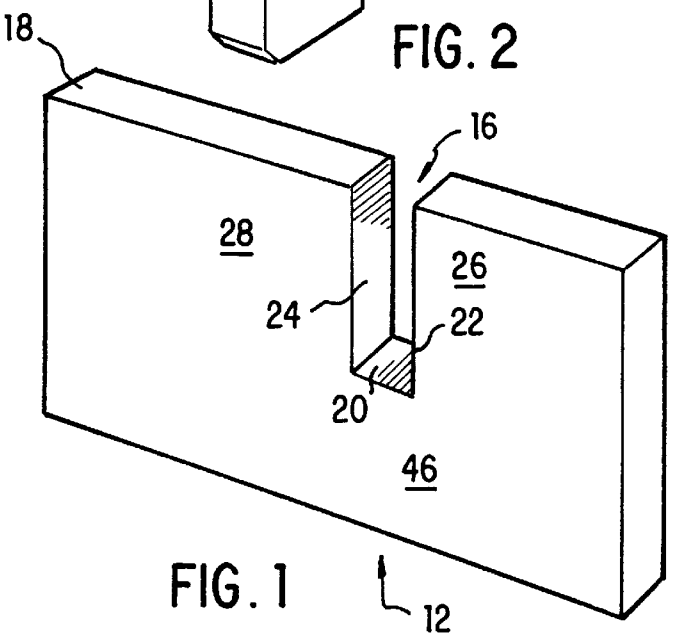

A first preferred embodiment of a pair of interconnecting puzzle pieces 12 and 14 is shown in FIGS. 1 and 2. The first piece 12 has a joint 16 provided along a first outer side edge 18 of piece 12. Joint 16 has a substantially U-shaped mortise part that is cut out of outer side edge 18. The substantially U-shaped mortise part is defined by a bottom edge 20 connected by two inner side edges 22 and 24. The inner side edges 22, 24 are substantially vertical so that the angle defined between the inner side edges 22, 24 and the outer side edge 18 is about ninety degrees. Thus, the joint 16 is defined by a U-shaped mortise opening having two side walls 26 and 28 on either side of the mortise opening.

The second piece 14 has a joint 30 that is essentially the same as joint 16. Joint 30 is provided along a first outer side edge 32 of piece 14, and has a substantially U-shaped mortise part that is cut out of outer side edge 32. The substantially U-shaped mortise part is defined by a bottom edge 34 connected by two inner side edges 36 and 38. The inner side edges are substantially vertical so that the angle defined between the inner side edges 36, 38 and the outer side edge 32 is about ninety degrees. Thus, the joint 30 is also defined by a U-shaped mortise opening having two side walls 40 and 42 on either side of the mortise opening. In the case of piece 14, since the body of the piece 14 between inner side edges 36, 38 and outer side edges 37, 39, respectively, is a thin strip of material, the outer side edges 32 and 37 and the inner side edge 36 define a first leg 40, and the outer side edges 32 and 39 and the inner side edge 38 define a first leg 42.

Although first and second pieces 12 and 14 are illustrated as having only one joint each, it is possible provide first and second pieces 12 and 14 with any number of joints at any location along any of the outer side edges of the piece, with the dimensions and configurations of the joints being varied by any of the other joints described hereinbelow.

Figure 3:
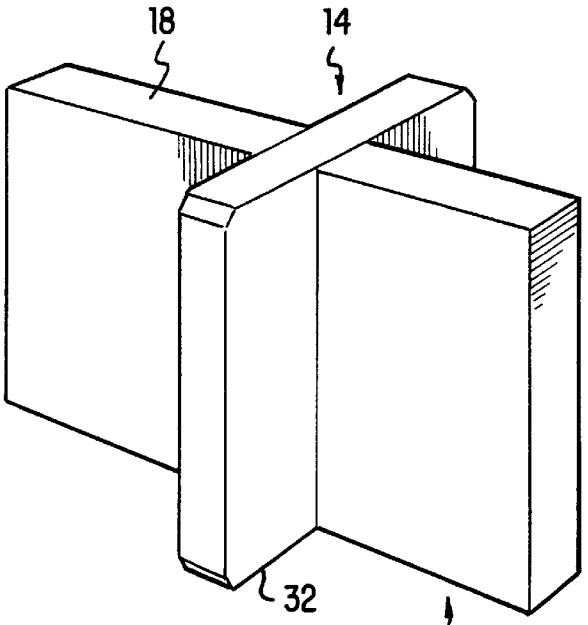
FIG. 3 is a perspective view of the puzzle pieces of FIGS. 1 and 2 after they have been interconnected.

FIG. 3 illustrates the interconnection of pieces 12 and 14. To connect joints 16 and 30, the U-shaped opening of the joint 16 is inserted into the U-shaped opening of the joint 30, or vice versa, in the direction and orientation of the pieces 12 and 14 shown in FIGS. 1 and 2, in a manner in which the U-shaped openings of the two joints 16 and 30 are transverse or orthogonal to each other.

When the interlocking connection is achieved, the inner side edges 22 and 24 of joint 16 are adapted to be adjacent or to contact the surfaces on both sides of the body of piece 14, such as at 44, so that the side walls 26 and 28 of joint 16 essentially grip the body of the piece 14. Likewise, the inner side edges 36 and 38 of joint 30 are adapted to be adjacent or to contact the surfaces on both sides of the body of piece 12, so that the legs or side walls 40 and 42 essentially grip the body of piece 12, such as at 46. Also, the bottom edges 20 and 34 of joints 16 and 30 are adapted to abut or be adjacent each other. Thus, the interlocking engagement or connection between joints 16 and 30 is about transverse planes. In other words, after the interlocking engagement, the body of piece 12 is in a plane that is orthogonal or transverse to the plane in which the body of piece 14 is disposed. This transverse interconnection provides a secure connection between the joints 16 and 30 because of the "gripping" action of the legs or side walls 26, 28 and 40, 42.

To disengage the connection, one piece 12 or 14 is pulled away from the other piece 14 or 12 to release the "grips" of the legs or side walls 26, 28 and 40, 42.

Although pieces 12 and 14 are illustrated as having substantially U-shaped mortise joints, it is possible to provide substantially U-shaped mortise joints having different dimensions and configurations, and positioned at different locations along the outer side edges of the pieces. For example, the length of the inner side edges and the width of the bottom edges of the joints can be varied for different joints. The angle of the joints with respect to the outer side edge can also be different from ninety degrees to provide angled joints. In addition, the outer side edges of the pieces can be curved, straight, or any combination thereof to provide pieces with different shapes.

Figures 4, 5:
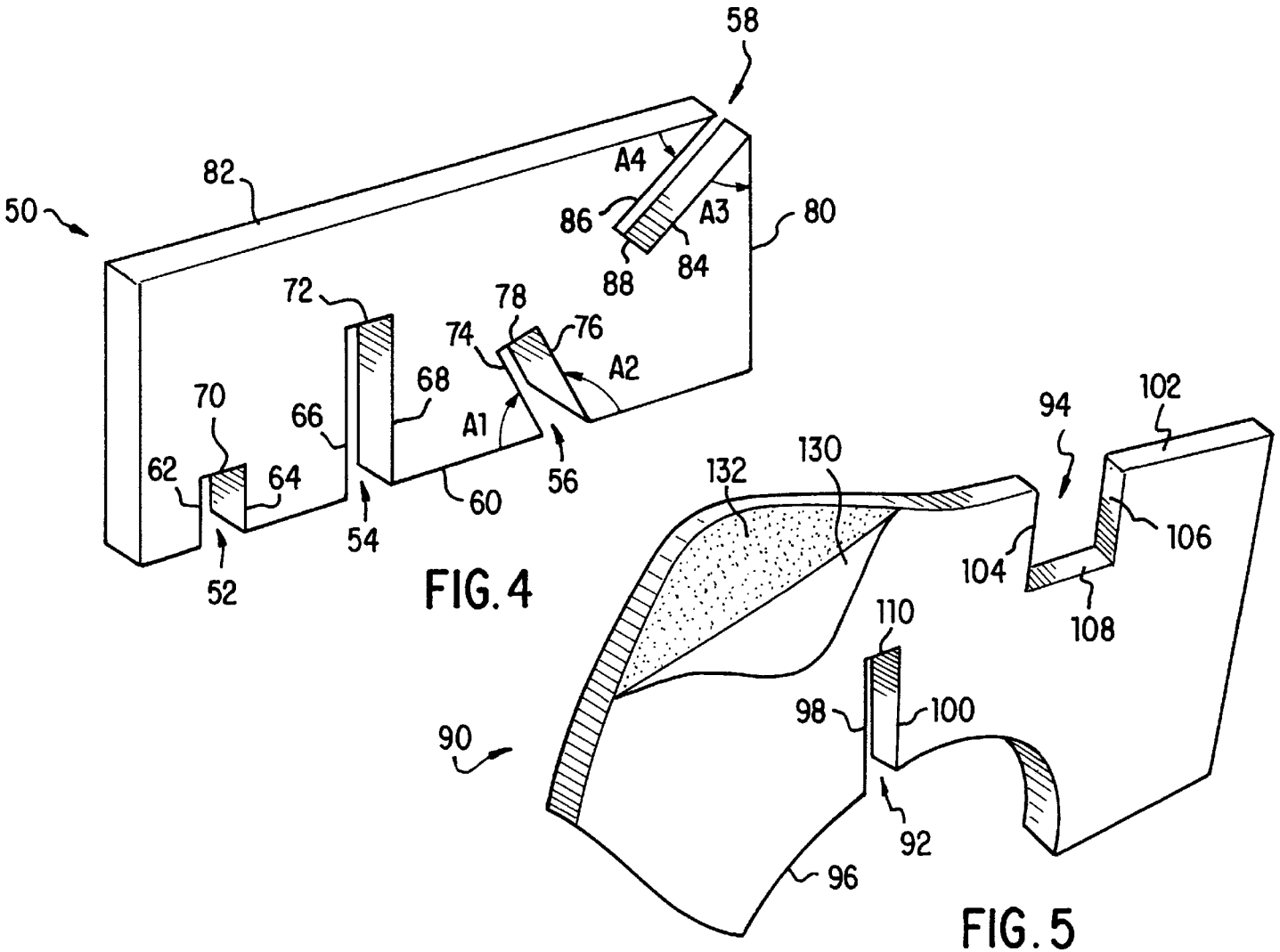
FIG. 4 is a perspective view of a puzzle piece according to a second embodiment of the present invention.
FIG. 5 is a perspective view of a puzzle piece according to a third embodiment of the present invention.

FIGS. 4 and 5 illustrate examples of different joints according to the present invention provided on two pieces 50 and 90. Piece 50 in FIG. 4 is illustrated as a substantially rectangular piece having four joints 52, 54, 56 and 58, each of which is different from the others. For example, joint 52 is provided along outer side edge 60, and its inner side edges 62, 64 are at right angles (i.e., ninety degrees) to outer side edge 60. Joint 54 is also provided along outer side edge 60, and its inner side edges 66, 68 are also at right angles to outer side edge 60. The difference between joints 52 and 54 is that inner side edges 66, 68 of joint 54 are longer than inner side edges 62, 64 of joint 52, so that the U-shaped opening of joint 54 is deeper than that of joint 52. In addition, the width of the bottom edges 70 and 72 of joints 52, 54, respectively, may also be different so that one U-shaped opening is wider than the other.

Joint 56 is also provided along outer side edge 60, but its inner side edges 74, 76 are angled with respect to outer side edge 60. For example, inner side edge 74 is angled with respect to outer side edge 60 at an angle Al which is greater than zero but less than ninety degrees, and inner side edge 76 is angled with respect to outer side edge 60 at an angle A2 which is greater than ninety but less than 180 degrees. With such a configuration, the length of inner side edge 74 is shorter than the length of inner side edge 76. Although bottom edge 78 of joint 56 is illustrated as not being parallel to outer side edge 60, it is also possible to provide bottom edge 78 substantially parallel to outer side edge 60.

In addition, the opening of joint 56 will have a consistent width (i.e., the distance of the opening between inner side edges 74 and 76) throughout if the degree of angles A1 and A2 add up to exactly 180 degrees. However, this is not always necessary. For example, if the degree of angles A1 and A2 adds up to less than 180 degrees, the width of bottom edge 78 will be greater than the width of the opening of joint 56 at the outer side edge 60. Conversely, if the degree of angles A1 and A2 adds up to be greater than 180 degrees, the width of bottom edge 78 will be less than the width of the opening of joint 56 at the outer side edge 60.

Joint 58 is provided at a corner between outer side edges 80 and 82. Inner side edge 84 is angled with respect to outer side edge 80, and inner side edge 86 is angled with respect to outer side edge 82. Inner side edges 84, 86 are angled with respect to outer side edges 80, 82 at angles A3 and A4, respectively, which are greater than zero but less than ninety. The angles A3 and A4 can be different so that the opening of the joint 58 can be wider or smaller as it extends from the bottom edge 88 to the outer side edges 80 and 82, or they can be the same to provide the opening at a consistent width throughout. In addition, depending on the angle of bottom edge 88 with respect to outer side edge 80, the length of inner side edges 84, 86 can be the same, or can be different.

Thus, each of the joints 52, 54, 56 and 58 are different from each other. Joint 56 is angled with respect to outer side edge 60, while joints 52 and 54 are substantially at right angles to outer side edge 60. Joint 58 is cut from a corner of two outer side edges 80 and 82. The depth (or length of inner side edges) can be varied for each joint, as well as the width of the bottom edge.

The piece 90 of FIG. 5 is illustrated as having curved outer side edges and including two joints 92 and 94. Joint 92 is provided along curved outer side edge 96, and its inner side edges 98, 100 are at right angles to outer side edge 96. Joint 94 is provided along outer side edge 102, and its inner side edges 104, 106 are also at right angles to outer side edge 102. The differences between joints 92 and 94 are that the length of inner side edges 98, 100 are longer than the length of inner side edges 104, 106, and the width of bottom edge 108 of joint 94 is wider than the width of bottom edge 110 of joint 92.

The puzzle pieces are preferably made from a soft material that is safe for use by children. A preferred material is foam, although other materials such as, but not limited to, plastic, wood, or paperboard, can be used without departing from the spirit and scope of the present invention.

Figure 8:
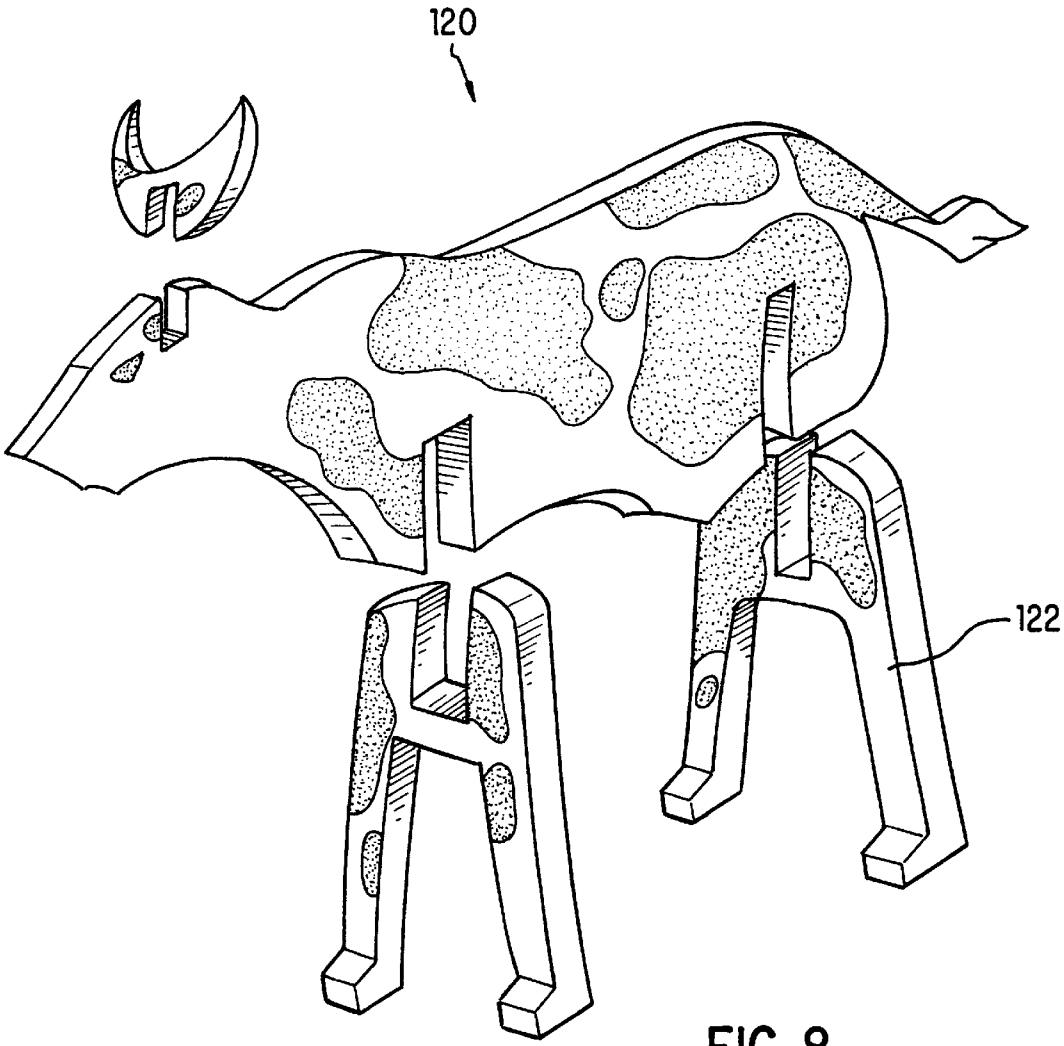
FIG. 8 is an exploded perspective view of the cow of FIG. 6 illustrating the various pieces thereof.

In addition, the surfaces and side edges of the puzzle pieces may be laminated or adhered with printed labels or may be directly printed with graphics, decals or other decorative images that match those of adjacent pieces when used to assemble a specific object. For example, FIG. 6 illustrates a cow 120 assembled from the puzzle pieces of the present invention. The pieces of the cow are provided with designs that match those of adjacent pieces to provide the desired cow. The rear legs of the cow 120 are provided in one piece 122 (see FIG. 7) which has a sheet of design 124 adhered or laminated to the body 126. FIG. 8 is an exploded view of the various pieces that make up the cow 120, and illustrates how the designs of each piece are matched to adjacent pieces. As an additional example, piece 90 in FIG. 5 is shown as having a sheet of design 130 that can be peeled off and adhered to the body 132 of piece 90.

While the description above refers to particular embodiments of the present invention, it will be understood that many modifications may be made without departing from the spirit thereof. The accompanying claims are intended to cover such modifications as would fall within the true scope and spirit of the present invention.

For example, although only portions of puzzle pieces may have been illustrated, this is merely to illustrate the matching joints. It will be appreciated that the actual puzzle pieces will be complete pieces. These pieces can be provided in different configurations and dimensions, each having joints provided at different locations in each piece in the manner desired. The joints in each piece may be dimensioned differently. The configurations of the pieces may in some cases be dictated by the locations and number of the joints. Different pieces can have a different number of joints angled at different planes to provide for connection of multiple pieces at about the same location.

As another non-limiting example, although the pairs of inner side edges of joints 16, 30, 52, 54, 92 and 94 have been illustrated as being at right angles to their respective outer side edges, it is also possible to provide one of the two inner side edges of a joint at an angle of other than ninety degrees with respect to the respective outer side edge, while providing the other inner side edge at ninety degrees with respect to the respective outer side edge.

The puzzle pieces and connectors according to the present invention can be used to assemble a large variety of two and three-dimensional objects. These connections are easy to achieve, and are secure.

What is claimed is:

1. An object including a first puzzle piece comprising:

a body having a first outer side edge and a second outer side edge;

a plurality of joints positioned along the first and second outer side edges, each joint having a substantially U-shaped mortise defined by a first side wall, a second side wall, and a straight bottom edge that connects the first and second side walls, with the bottom edge of at least one joint having a width which is different from the width of the bottom edge of the other joints; and wherein the first puzzle piece comprises a corner connecting the first and second outer side edges, and a corner joint provided at the corner, the corner joint having a substantially U-shaped mortise defined by a first side wall, a second side wall and a bottom edge, with the first side wall of the corner joint extending from the bottom edge to the first outer side edge, and the second side wall of the corner joint extending from the bottom edge to the second outer side edge.

2. The object of claim 1, wherein the first and second side walls are parallel to each other.

3. The object of claim 1, further having a second puzzle piece that comprises:

a body having a first outer side edge;

a joint positioned along the first outer side edge and having a substantially U-shaped mortise defined by a first side wall, a second side wall, and a bottom edge that connects the first and second side walls;

wherein the bodies of the first and second puzzle pieces are transverse to each other when one joint of the first puzzle piece is interconnected with the joint of the second puzzle piece.

4. The object of claim 3, wherein the bodies of the first and second puzzle pieces have designs provided thereon, and wherein the designs of the first and second bodies match each other when the joint of the first puzzle piece is interconnected with the joint of the second puzzle piece.

5. The object of claim 1, wherein the length of the side walls of at least one of the joints of the first puzzle piece is different from the length of the side walls of the other joints of the first puzzle piece.

6. The object of claim 1, wherein the first side wall of one joint of the first puzzle piece is positioned at an angle of greater than zero degrees and less than ninety degrees with respect to the first outer side edge, and the second side wall of the same joint of the first puzzle piece is positioned at an angle of greater than ninety degrees and less than 180 degrees with respect to the first outer side edge, wherein the degree of the first angle and the second angle of the joint of the first puzzle piece adds up to a total which is less than 180 degrees.

7. An object having a first puzzle piece comprising:

a body having a first outer side edge;

a joint positioned along the first outer side edge and having a substantially U-shaped mortise defined by a first side wall, a second side wall and a bottom edge that connects the first and second side walls, the first side wall positioned at a first angle of greater than zero degrees and less than ninety degrees with respect to the first outer side edge, and the second side wall positioned at a second angle of greater than ninety degrees and less than 180 degrees with respect to the first outer side edge, wherein the degree of the first angle and the second angle of the joint adds up to a total which is less than 180 degrees.

8. The object of claim 7, further including a second puzzle piece comprising:

a body having a first outer side edge;

a joint positioned along the first outer side edge and having a substantially U-shaped mortise defined by a first side wall, a second side wall, and a bottom edge that connects the first and second side walls; and wherein the bodies of the first and second puzzle pieces are transverse to each other when the joint of the first puzzle piece is interconnected with the joint of the second puzzle piece.

9. The object of claim 8, wherein the length of the side walls of the joint of the first puzzle piece is different from the length of the side walls of the joint of the second puzzle piece.

10. The object of claim 8, wherein the bodies of the first and second puzzle pieces have designs provided thereon, and wherein the designs of the first and second bodies match each other when the joint of the first puzzle piece is interconnected with the joint of the second puzzle piece.

11. The object of claim 8, wherein the bottom edge of the joint of the first puzzle piece has a width which is different from the width of the bottom edge of the joint of the second puzzle piece.

12. The object of claim 11, wherein the first and second side walls of each of the joints of the first puzzle piece are parallel to each other.

13. The object of claim 7, wherein the first puzzle piece includes a second outer side edge, a corner connecting the first and second outer side edges, and a second joint provided at the corner, the second joint having a substantially U-shaped mortise defined by a first side wall, a second side wall, and a bottom edge connecting the first and second side walls, with the first side wall extending from the bottom edge to the first outer side edge, and the second side wall extending from the bottom edge to the second outer side edge.

14. The object of claim 7, wherein the first and second side walls of the joint defines an opening, and wherein the width of the bottom edge is greater than the width of the opening.

15. An object including:

(a) a first puzzle piece comprising:

a body having a first outer side edge and a second outer side edge; and a plurality of joints positioned along the first and second outer side edges, each joint having a substantially U-shaped mortise defined by a first side wall, a second side wall, and a straight bottom edge that connects the first and second side walls, with the bottom edge of at least one joint having a width which is different from the width of the bottom edge of the other joints; and (b) a second puzzle piece comprising:

a body having a first outer side edge; and a joint positioned along the first outer side edge and having a substantially U-shaped mortise defined by a first side wall, a second side wall, and a bottom edge that connects the first and second side walls;

(c) means for interconnecting one joint of the first puzzle piece with the joint of the second puzzle piece in a manner so that the bodies of the first and second puzzle pieces are transverse to each other.

16. The object of claim 15, wherein the first and second side walls of the joints of the first puzzle piece are parallel to each other.

17. The object of claim 15, wherein the length of the side walls of at least one of the joints of the first puzzle piece is different from the length of the side walls of the other joints of the first puzzle piece.

18. The object of claim 15, wherein the first side wall of one joint of the first puzzle piece is positioned at an angle of greater than zero degrees and less than ninety degrees with respect to the first outer side edge, and the second side wall of the same joint of the first puzzle piece is positioned at an angle of greater than ninety degrees and less than 180 degrees with respect to the first outer side edge, wherein the degree of the first angle and the second angle of the joint of the first puzzle piece adds up to a total which is less than 180 degrees.

* * * * *